US007114834B2

(12) United States Patent
Rivas et al.

(10) Patent No.: US 7,114,834 B2
(45) Date of Patent: Oct. 3, 2006

(54) LED LIGHTING APPARATUS

(75) Inventors: Nelson Rivas, East Meadow, NY (US); Joseph Abdale, North Babylon, NY (US)

(73) Assignee: Matrix Railway Corporation, West Babylon, NY (US)

( * ) Notice: Subject to any disclaimer, the term of this patent is extended or adjusted under 35 U.S.C. 154(b) by 107 days.

(21) Appl. No.: 10/668,905

(22) Filed: Sep. 23, 2003

(65) Prior Publication Data

US 2004/0156199 A1 Aug. 12, 2004

Related U.S. Application Data

(60) Provisional application No. 60/412,692, filed on Sep. 23, 2002.

(51) Int. Cl.

| | |
|---|---|
| ***F21V 29/00*** | (2006.01) |
| ***F21V 5/02*** | (2006.01) |
| ***F21V 7/00*** | (2006.01) |
| *F21V 1/00* | (2006.01) |

(52) U.S. Cl. ..... 362/373; 362/240; 362/245; 362/328

(58) Field of Classification Search ..... 362/240, 362/243, 244, 245, 246, 247, 294, 328, 339, 362/373, 800

See application file for complete search history.

(56) References Cited

U.S. PATENT DOCUMENTS

| | | | | |
|---|---|---|---|---|
| 3,735,239 | A | 5/1973 | LaDuca | |
| 4,177,502 | A * | 12/1979 | Hiscock | 362/240 |
| 4,317,040 | A | 2/1982 | Wuerflein | |
| 4,350,891 | A | 9/1982 | Wuerflein | |
| 4,641,233 | A | 2/1987 | Roy | |
| 4,729,076 | A | 3/1988 | Masami et al. | |
| 4,798,971 | A | 1/1989 | Gravely | |
| 4,847,734 | A | 7/1989 | Katoh et al. | |
| 4,874,228 | A * | 10/1989 | Aho et al. | 362/339 |
| 4,929,866 | A | 5/1990 | Murata et al. | |
| 4,939,426 | A | 7/1990 | Menard et al. | |
| 4,954,931 | A | 9/1990 | Hassler, Jr. | |
| 4,978,948 | A * | 12/1990 | Samen | 362/806 |
| 5,113,337 | A | 5/1992 | Steigerwald | |
| 5,459,955 | A | 10/1995 | Ruskouski et al. | |
| 5,463,280 | A | 10/1995 | Johnson | |
| 5,548,189 | A | 8/1996 | Williams | |
| 5,643,280 | A | 7/1997 | Del Rio et al. | |
| 5,709,460 | A | 1/1998 | Lester | |
| 5,785,418 | A | 7/1998 | Hochstein | |

(Continued)

*Primary Examiner*—Y. My Quach-Lee
(74) *Attorney, Agent, or Firm*—Collard & Roe, P.C.

(57) ABSTRACT

A light comprising a housing, a plurality of LED lights coupled in an array inside of the housing, and a reflective protrusion coupled to the housing wherein the reflective protrusion is for reflecting light from the LED lights out of the housing. The housing can be of any shape such as tubular, bowl shaped, or having an oval cross section. In addition, the reflective protrusion can be of any shape such as dome shaped or pyramidal shaped. The circuitry relating to this LED light array can include a power source such as a connection to an AC or DC input. If the connection is to an AC input, the device can also include an AC/DC converter coupled to the power source for receiving an input from the AC power source. In this way the LED array receives a consistent flow of DC current that will not result in the LED lights burning out. To prevent this LED array from burning out there is also a current regulator for controlling a current flowing through this LED array.

18 Claims, 21 Drawing Sheets

U.S. PATENT DOCUMENTS 5,899,684 A 5/1999 McCoy et al.
5,929,788 A * 7/1999 Vukosic ..... 362/800
6,045,240 A 4/2000 Hochstein
6,067,236 A 5/2000 White
6,099,295 A 8/2000 McCoy et al.
6,135,612 A * 10/2000 Clore ..... 362/247
6,158,882 A 12/2000 Bischoff, Jr.
6,190,020 B1 * 2/2001 Hartley ..... 362/800
6,236,331 B1 5/2001 Dussureault
6,255,786 B1 7/2001 Yen
6,283,612 B1 9/2001 Hunter
6,361,186 B1 3/2002 Slayden
6,362,578 B1 3/2002 Swanson et al.
6,472,823 B1 10/2002 Yen
6,486,726 B1 11/2002 Worley, Sr. et al.
6,491,412 B1 12/2002 Bowman et al.
6,520,655 B1 2/2003 Ohuchi
6,536,924 B1 * 3/2003 Segretto ..... 362/247
6,547,423 B1 4/2003 Marshall et al.
6,549,438 B1 4/2003 Malone
6,582,103 B1 6/2003 Popovich et al.
6,583,550 B1 6/2003 Iwasa et al.
6,585,393 B1 7/2003 Brandes et al.
6,666,565 B1 12/2003 Gabe
6,676,284 B1 * 1/2004 Wynne Willson ..... 362/246
6,767,107 B1 7/2004 Liefer et al.
2002/0006039 A1 1/2002 Ueda et al.
2003/0039121 A1 * 2/2003 Nezigane ..... 362/247
2003/0095404 A1 5/2003 Becks et al.

* cited by examiner

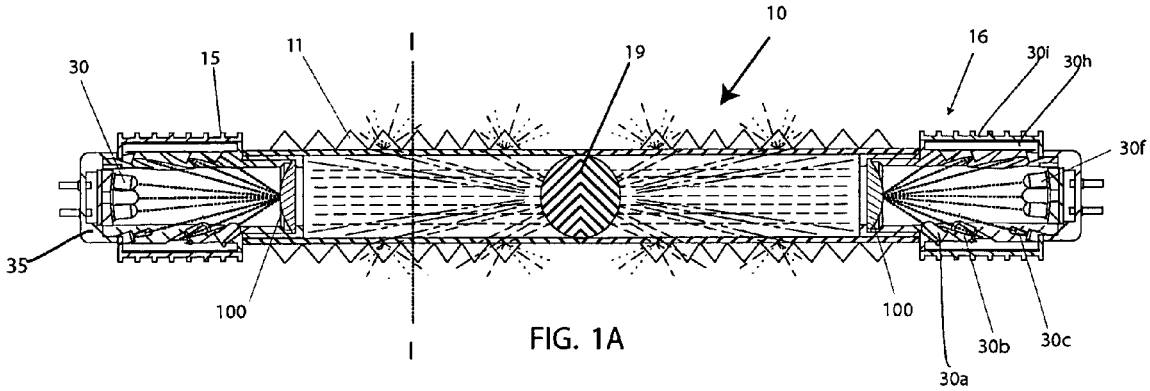
FIG. 1A
FIG. 1B
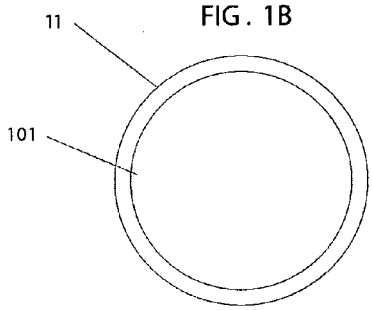

FIG. 1E
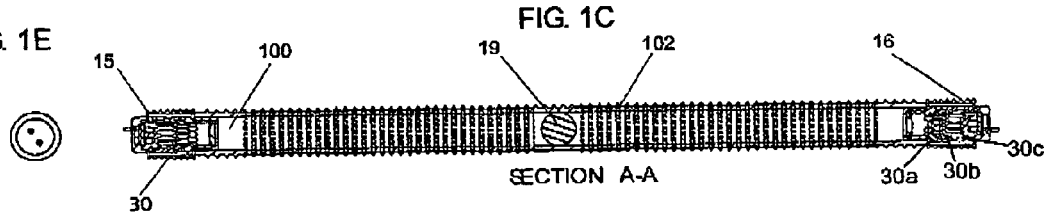
FIG. 1C
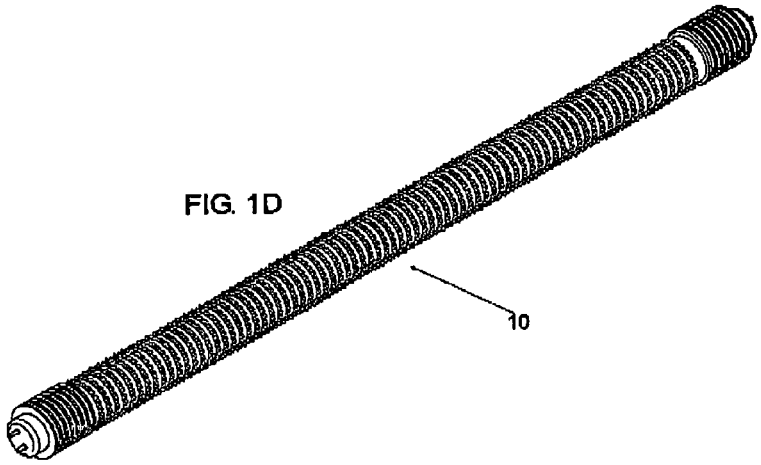
FIG. 1D

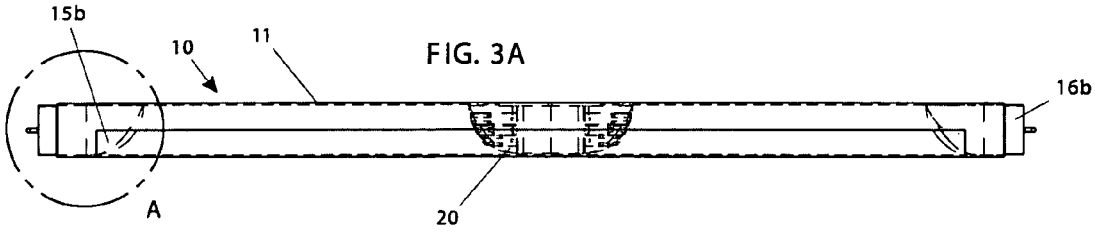
FIG. 3A
FIG. 3B
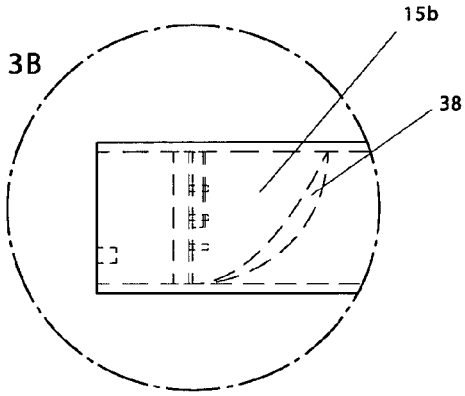
DETAIL A
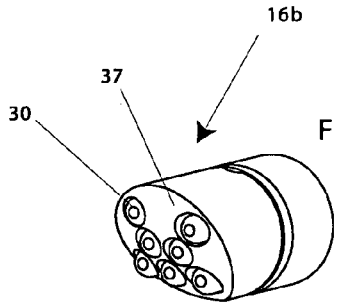
FIG. 3C
FIG. 3D
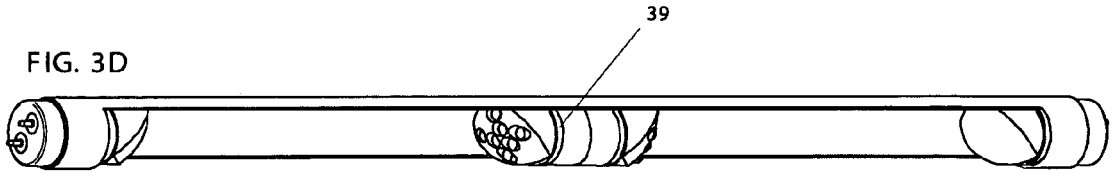

SECTION A-A

SECTION XII-XII

LED LIGHTING APPARATUS

CROSS REFERENCE TO RELATED APPLICATIONS

The applicant hereby claims priority under 35 U.S.C. 119e from provisional application Ser. No. 60/412,692 filed on Sep. 23, 2002.

BACKGROUND OF THE INVENTION

The invention relates to an LED light that is disposed within a housing having a reflector disposed therein.

SUMMARY OF THE INVENTION

The invention relates to a lighting device comprising a housing, a plurality of LED lights coupled in an array inside of the housing, and a reflective protrusion or simply a reflector coupled inside the cylindrical prismatic housing wherein the reflective protrusion is for reflecting light from the LED lights out of the cylindrical prismatic housing.

One of the reasons for the invention is to provide the appearance of an even, omni-directional light source extending in a 360 degree manner to create uniform light distribution about a room. Lighting with Fluorescent light bulbs provides a substantially even glow in an omnidirectional manner so that there are no unlit areas (or dead spots) around the outside cylindrical area were light bulb emits light. The fluorescent light radially emits light at 360 degrees about its cylindrical radius. Therefore, the design which relates to the invention is designed to approach a uniform, omnidirectional lighting source, wherein by using LED lights, this is accomplished in a more efficient manner than with ordinary incandescent bulbs.

The housing can comprise a first end; a second end; and a cover coupling the first end to said second end. The cover is translucent. In one embodiment, a first LED array is coupled to a first end of the housing and a second LED array is coupled to a second end of the housing.

The housing can be formed in many shapes. For example, the housing can be substantially tubular shaped or formed with a circular cross section such as bowl shaped or formed with a substantially oval cross section. In addition, the protrusion can be formed in many different shapes as well. For example, the protrusion can be dome shaped, pyramidal shaped or spherical. There can also be a stand-alone reflector in the form of a sphere or semi-spherical design. Furthermore, the protrusion can be formed with rounded or angled sides.

To further increase the reflectiveness and the scattering of light the translucent cover comprises a plurality of prismatic lenses which can be in a sheet that assist in scattering the light as it is emitted by the LED lights.

To prevent the housing or the circuitry relating to the LED lights from overheating, the LED light array is coupled to a heat sink. In many cases, this heat sink is disposed in an end region of the housing.

The circuitry relating to this LED light array can include a power source such as a connection to an AC or DC input. If the connection is to an AC input, the device can also include an AC/DC converter coupled to the power source for receiving an input from the AC power source. In this way, the LED array receives a consistent flow of DC current that will not result in the degradation or burning out of LED lights. In addition, each of the LED lights in each of the LED arrays is coupled to an adjacent LED light in both series and in parallel, so that if one LED light burns out, the adjacent LED lights do not burn out. To prevent this LED array from burning out, there is also a current regulator for controlling a current running through this LED array. The current regulator can, for example regulate that only the current required by the LED passes through the array. This current regulator allows the device to connect to many different power sources with different input voltages. The circuitry relating to the LED light array uses a constant current design which is highly efficient and results in very minor heat losses.

BRIEF DESCRIPTION OF THE DRAWINGS

Other objects and features of the present invention will become apparent from the following detailed description considered in connection with the accompanying drawings which disclose at least one embodiment of the present invention. It should be understood, however, that the drawings are designed for the purpose of illustration only and not as a definition of the limits of the invention.

In the drawings, wherein similar reference characters denote similar elements throughout the several views:

FIG. 1A is a side cross-sectional view of a first embodiment

FIG. 1B is a side cross sectional view of the view in FIG. 1A taken along line I—I;

FIG. 1C is a side view of the device which includes a prismatic film disposed on tube;

FIG. 1D is a perspective view of the device shown in FIG. 1C;

FIG. 1E is a side view of the device shown in FIG. 1D;

FIG. 3A is a side view of the third embodiment of the invention;

FIG. 3B is a detailed view of an end section shown in FIG. 3A;

FIG. 3C is a perspective view of an end section as shown in FIG. 3A;

FIG. 3D is a bottom-side perspective view of the embodiment shown in FIG. 3A;

FIG. 6D is a perspective view of the embodiment shown in FIG. 6A with the cover on;

DETAILED DESCRIPTION OF PREFERRED EMBODIMENTS

Figure 2A:
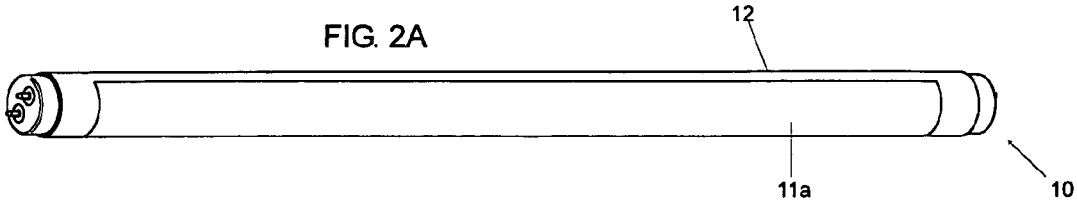
FIG. 2A is a perspective view of a second embodiment of the invention.

Turning now in detail to the drawings, FIG. 1A is a side cross-sectional view of a first embodiment of the invention. This view shows from an outside perspective, a design similar to that of a phosphorescent or florescent tubular bulb. With this device 10 there is a housing formed from a translucent-prismatic lens 11 and end caps 15 and 16 attached at each end. Inside of cover or tube 11, is a reflective sphere 19, which is used to reflect light from LED lights 30 which are embedded into a lighting housing 35 in end caps 15 and 16. LED lights 30 are arrayed in lighting housing 35 so that they shine a light onto a common point on collimator lens 100. For example, there are a plurality of different LED arrays disposed at precise angles with a first array in the form of array 30*a* comprising a plurality of lights arranged around a rim of lighting housing 35. This first set of LED lights in array 30*a* are set at a first angle to shine on a central region of lens 100. A second set of LED lights in array 30*b* are arrayed around the rim of lighting housing 35 and are set at a different angle than that of first array 30*a*. LED lights in arrays 30*a*, 30*b* and 30*c* are all set in lighting housing 35 at different angles than the respective remaining arrays. In this way, the LED lights from these different arrays all shine on a central region of lens 100 wherein this light is then collimated by collimating lens 100. LED array 30*f* is in the form of a backplate which houses a series of lights disposed at a precise angle around this back plate. These LEDs are directed radially inward to a central region on lens 100. In this way, there is little light lost due to reflection because all of the lights are directed towards a central region of collimating lens 100.

To achieve this result of little light loss, LED lights 30 are positioned at different angles in an aluminum housing that also serves as heat sink to create a common point for convergence of the light. The heat collected by the aluminum housing is absorbed by a non-conducting insulating pad 30*h* and transferred to a secondary heat sink 30*i* which dissipates heat to the surroundings. Lens 100 is a collimating lens, which is disposed in tube 11 and is used to focus the light so that it creates a common light pattern with virtually no loss of light. For example, if two or more beams are shined on a common object, the two or more beams could flow in the same path out of phase so that the result would be an amplification of total light for each beam added without much loss. However, if two or more beams are shined on an object and flowing along the same path and in phase, then there is no additional gain of light from this feature.

Thus, lens 100 is disposed inside of cover 11 so to act as a collimator so that it can be used to collimate the light emanating from LED lights 30 so that the different rays of light do not flow along a substantially same path. LED lights 30 can be of any color but would preferably be used to give the appearance of white light.

FIG. 1B is a cross-sectional view of the tube 11 taken along line I—I. In this view there is shown a copy of the tube 11 with a prismatic film 101 inserted therein. Prismatic Film 101 is in the form of a semi-transparent, translucent film which is designed to reflect, and refract the light to provide the effect of a uniformly distributed light pattern. Prismatic film 101 can be in the form of a prismatic film that refracts light to create a consistent flow of light out of film 101.

FIG. 1C is a side view of the device 10 which includes a prismatic film or texture 102 disposed on an outside of tube 11. With this design there is spherical reflector 19 coupled therein wherein a central region of this prismatic film 102 is shown removed for the purpose of showing spherical reflector 19. Endcaps 15 and 16 are coupled to tube 11 wherein these endcaps show lens 100 and a plurality of LED arrays extending around in rings. Each LED array includes LED lights 30 which are angled at lens 100 at the same angle with the angles of the LED lights differing between the different LED arrays. For example, in the first LED array 30A, the LED lights are pointed at lens 100 at a 39° angle. In the second LED array 30B, the LED lights are pointed at lens 100 at a 24° angle. In the third LED array 30C the LED lights are pointed at lens 100 at a 15° angle.

These lights then shine in a radial inward pattern pointed at a center region on lens 100. FIG. 1D shows a full perspective view of this embodiment, while FIG. 1E shows as side view of the embodiment in FIG. 1D.

Figure 4A:
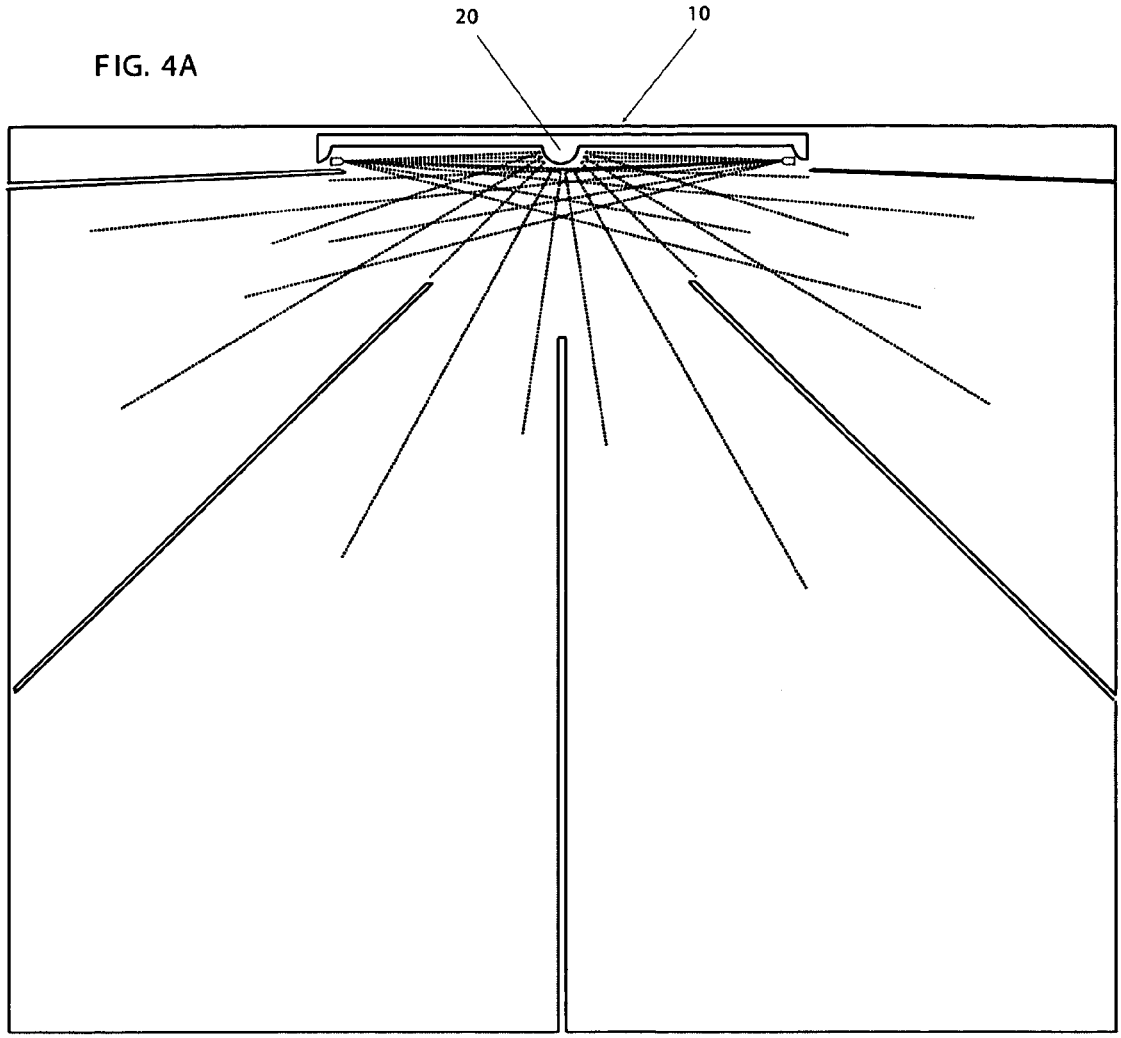
FIG. 4A is a side view of the embodiment shown in FIG. 2A.

FIG. 2A is a light whose source of light originates from the left end and the right end. This light is then shone onto the center reflector. The light distribution pattern generated is illustrated in FIG. 4*a*.

Figure 2B:
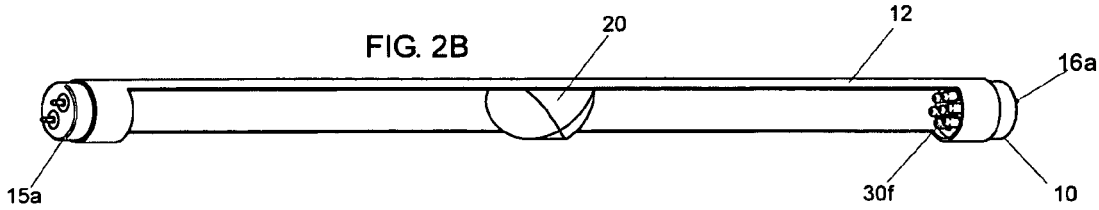
FIG. 2B is a perspective view of the view of FIG. 2A with a cover removed.

FIG. 2A is a side perspective view of the embodiment of this design wherein this view shows cover 11*a* which is coupled to a housing base section 12. Cover 11*a* can be tubular or semi-tubular and can attach to base section 12. FIG. 2B is a perspective view of the view of FIG. 2A with cover 11*a* removed. In this view, there are two ends 15*a* and 16*a* coupled together via base section 12. Base section 12 is formed with a semi-circular cross-section with a reflective inner face to reflect light out of the housing through prismatic translucent cover 11*a*.

A reflective protrusion 20 which has a mirror surface 20 is coupled to base section 12 and is in the form of a substantially dome shaped element. There is also a first LED array 30*g* coupled to first endcap 15*a* so that first LED array 30*g* shines light from LED lights into the housing so that it is reflected from the inner face of base section 12 and protrusion 20.

Figure 2C:
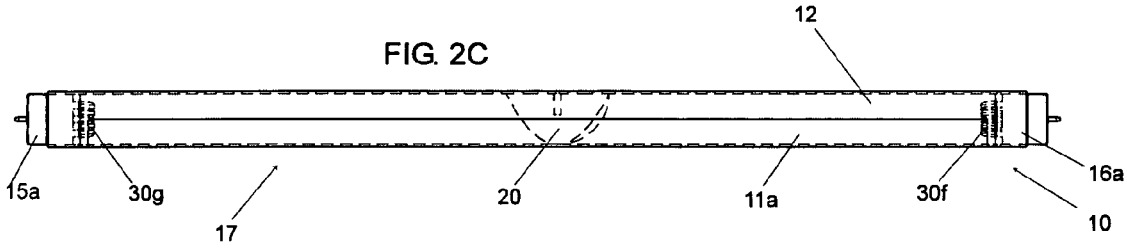
FIG. 2C is a side view through the housing with the cover shown in dashed lines.

In addition, FIG. 2C is a side view through the housing with the cover shown in dashed lines, in this view, a second LED array 30*f* is shown coupled to second end 16*a* so that light from this LED array can be shined or shone through the housing and out of the housing so that it can illuminate a room.

Essentially in this design, light emanates from LED arrays 30*f* and 30*g* and reflects off of reflective dome 20. This reflected light then emanates out of the prismatic cover 11*a*. In addition, light which emanates from LED arrays 30*f* and 30*g* also passes through cover 11*a* to light a room without reflecting off of reflector 20.

For example, this light could either pass directly from the associated LED array through cover 11 or it could reflect off of reflective support or base section 12 which has a highly reflective interior surface.

FIG. 3A is a light whose source of light originates at the center light. This light is then shone onto the right and left reflectors. The light distribution pattern generated is illustrated on FIG. 4*b*.

In this case, there are different style end pieces 15*b*, and 16*b* which can be of different shapes for example having a sloped front surface 37 and 38 (See FIGS. 3B and 3C) which form a reflector for reflecting light that is sent. As shown in FIG. 3D, there are also unique intermediate lighting housings 39 having a sloped front section and a plurality of LED lights coupled therein.

Figure 4B:
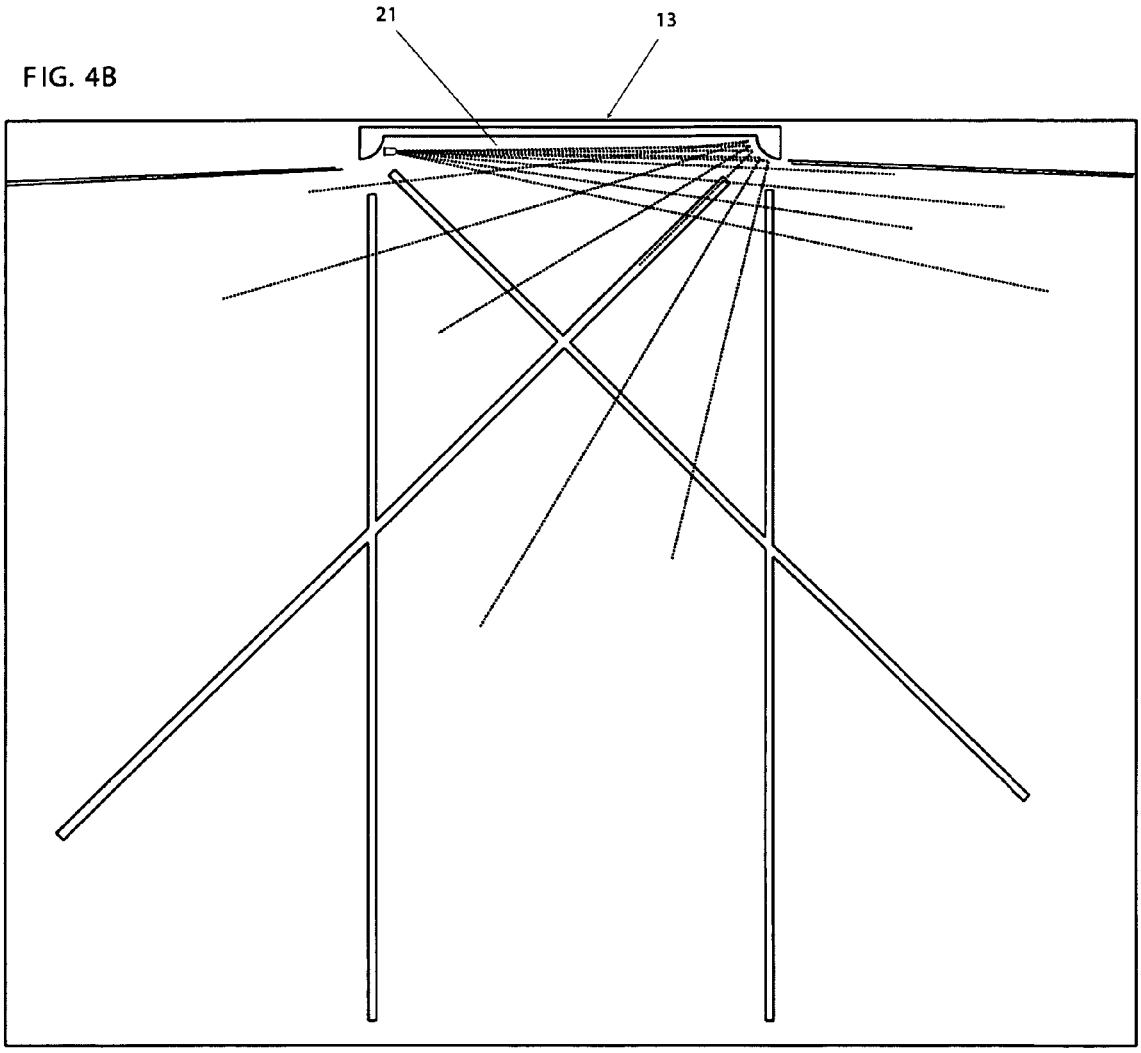
FIG. 4B is a side view of another embodiment of the invention.

FIGS. 4A and 4B show two different types of designs for two different types of reflective protrusions. For example, FIG. 4*a* shows device 10 having a reflective protrusion 20. Reflective protrusion 20 is formed as semi-spherical as shown in FIGS. 2B–2C. FIG. 4B shows a device 13 having a reflective protrusion 21 which is oblong in shape wherein this reflector 21 has a substantially mirrored surface and is used to reflect light from this surface.

Figure 5A:
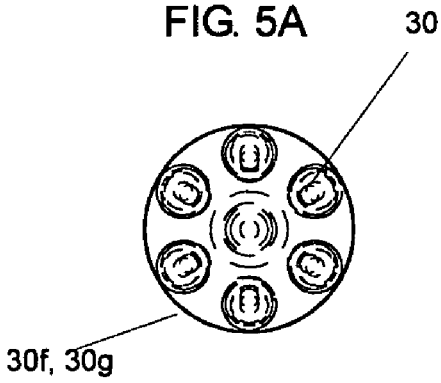
FIG. 5A is an end view of an end piece shown in FIG. 1A.
Figure 5B:
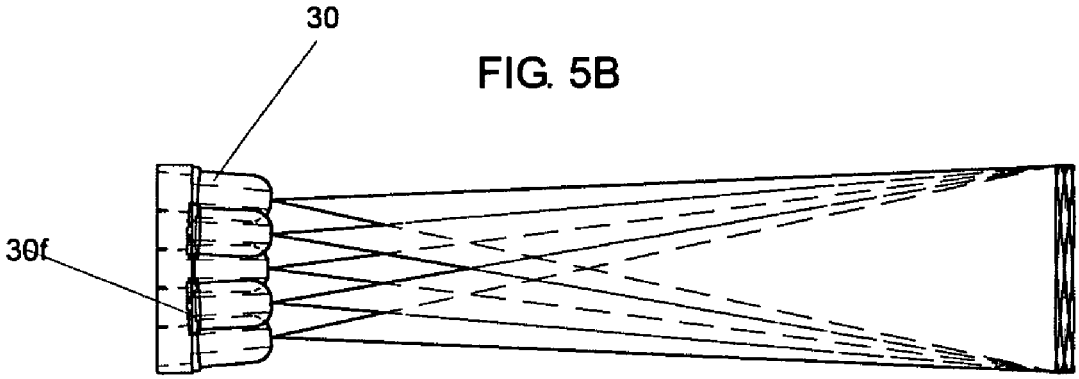
FIG. 5B is a side view of the end piece shown in FIG. 5A.
Figure 5C:
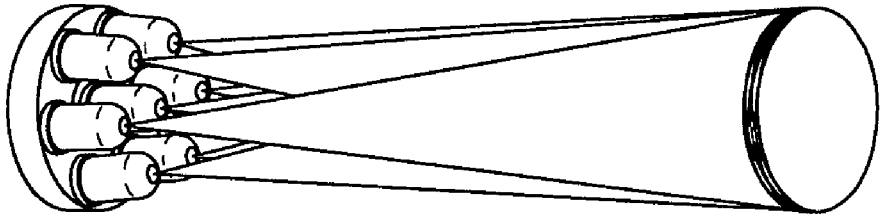
FIG. 5C is a perspective view of the end piece shown in FIG. 5A.
Figure 6A:
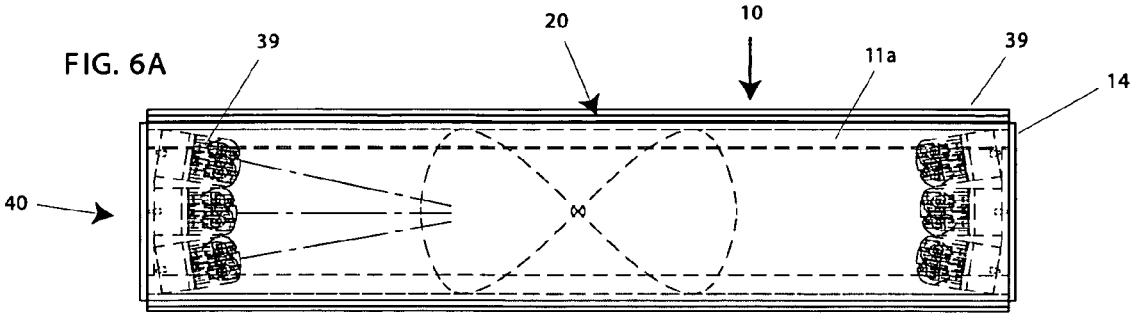
FIG. 6A is a side view of another embodiment of the invention.
Figure 6B:
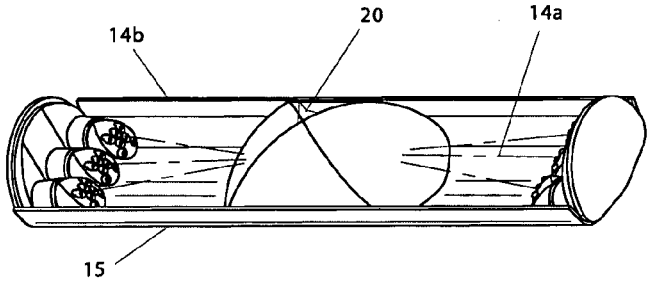
FIG. 6B is a perspective view of the embodiment shown in FIG. 6A with the cover removed.
Figure 6C:
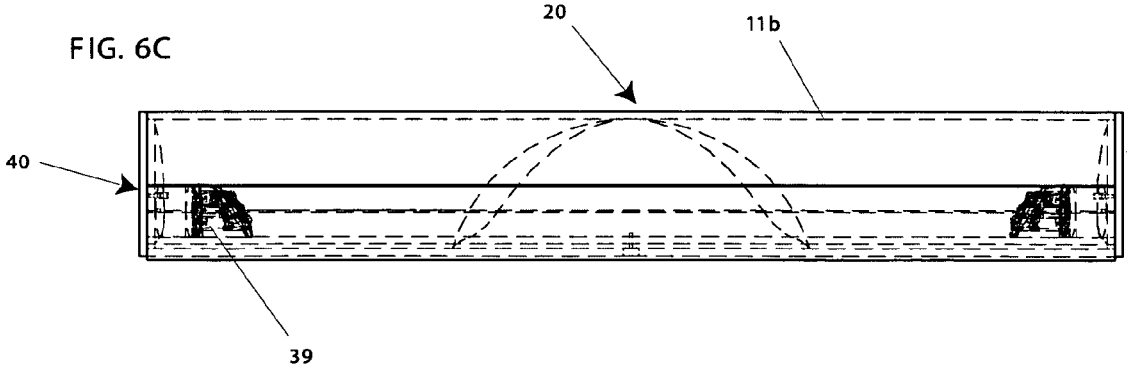
FIG. 6C is a side view of the embodiment shown in FIG. 6B.
Figure 6D:
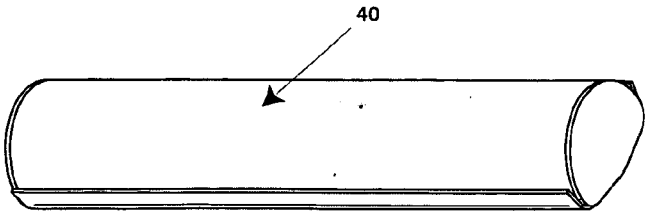

FIGS. 5A, 5B and 5C disclose at different viewing angles an LED array 30*f* and 30*g*, which includes LED lights 30 coupled therein. This LED array 30*f* and 30*g* includes a spacer which aligns an LED cluster into a single point or region and brings all the light coming from each LED into a central region so that maximum light output is realized at the focal point where all the light comes together.

FIGS. 6A, 6B, 6C and 6D involve another embodiment of the design 40, wherein in this design, there is a new type base section 14 which includes a central reflecting protrusion 20, but base section 14 is not tubular in shape as in base section 12 in FIG. 2A. Instead, this base section 14 has a semi-oval cross-section wherein there is a flattened, or slightly rounded base plate 14*a* and rounded sides 14*b* which can be used to receive a correspondingly shaped cover 11*b*. Protrusion 20 is coupled to base plate 14*a* and also two sides 14*b* to provide a continuous reflective surface for reflecting light emanating from the coupled in LED arrays 39 which are patterned after endcaps 15*a* and 15*b* shown in FIGS. 3A, 3B and 3C. This set of LED arrays create a different version of the overall uniform light distribution pattern.

Figure 7A:
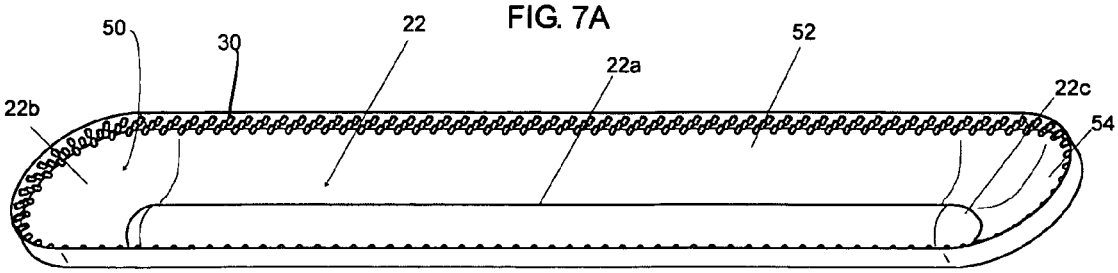
FIG. 7A is a perspective view of another embodiment of the invention with a cover removed.
Figure 7B:
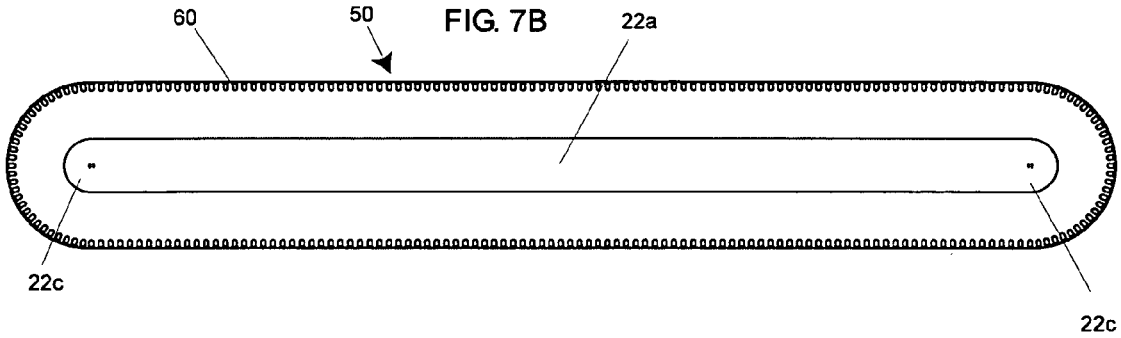
FIG. 7B is a top view of the embodiment shown in FIG. 7A.
Figure 7C:
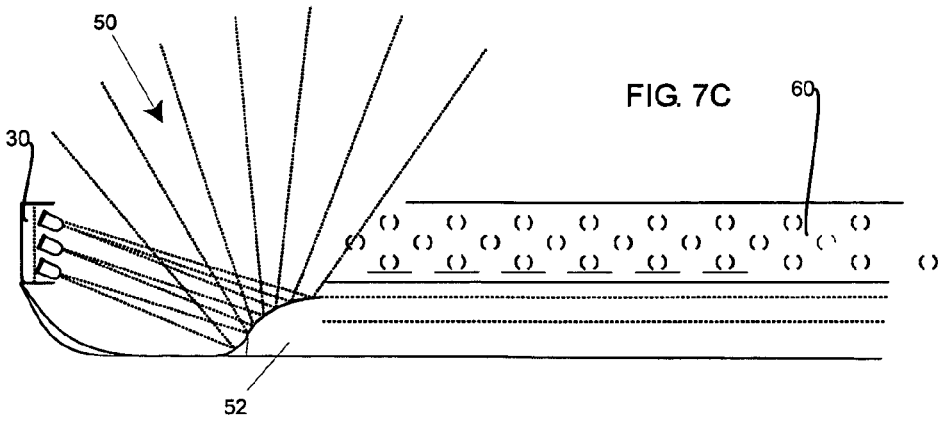
FIG. 7C is a side transparent view of the device shown in FIG. 7A.

FIGS. 7A, 7B and 7C disclose another design, which involves a base section 50 having a base plate 52, and a set of side walls 54. Base section 52 is concave in shape and forms a bowl or recess as shown in FIG. 7C. Reflective protrusion 22 extends out from base section 52 and is shaped in an oblong manner so that it has an oblong semi-cylindrical body 22*a* and rounded end caps 22*b* and 22*c*. LED lights 30 are coupled into side walls 54 and form a new LED array 60 wherein these LED lights point to reflective protrusion 22 so that once light shines on this protrusion 22, it is reflected out from base section 50. In this case, an interior region of base section 50 including side walls 54, base plate 52 and protrusion 22 are all made from a reflective surface such as a mirror reflector, however reflective protrusion 22 may be made from a different reflective material than the remaining interior reflective material on base section 50.

Figure 8A:
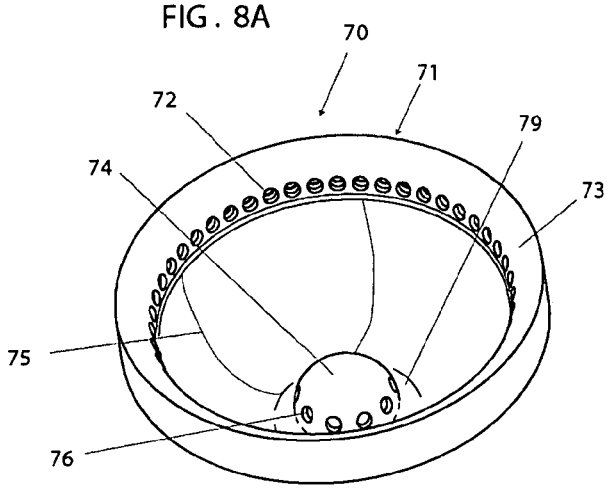
FIG. 8A is a perspective view of another embodiment of the invention.
Figure 8C:
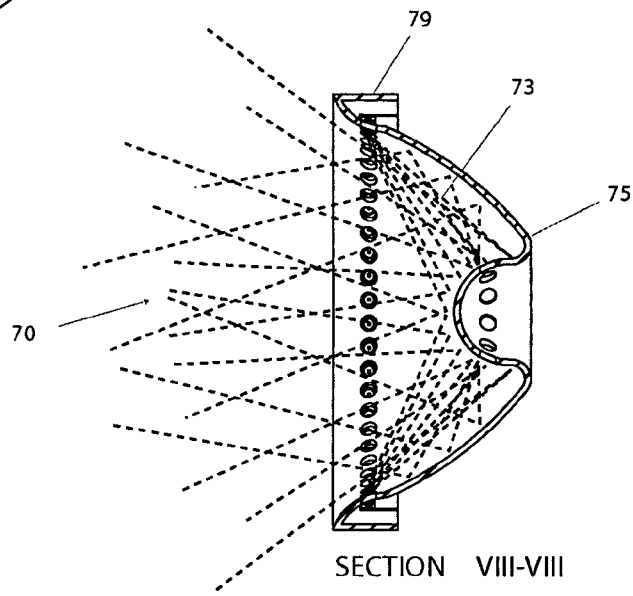
FIG. 8C is a side transparent view of the emboidment shown in FIG. 8A.
Figure 8B:
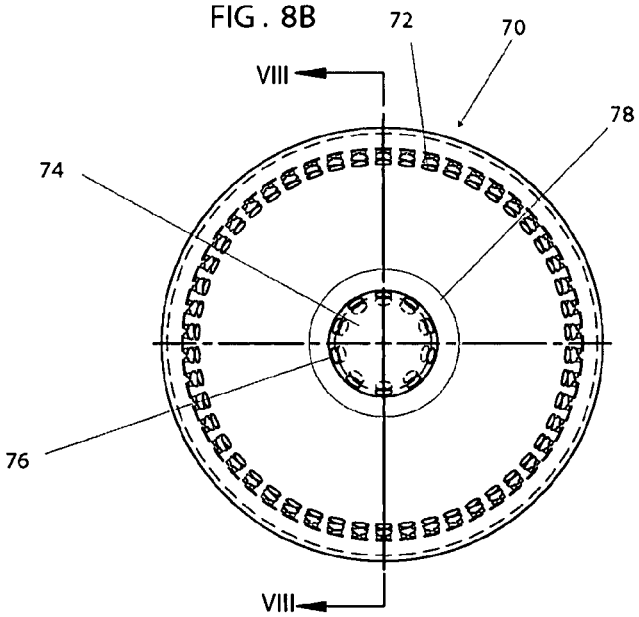
FIG. 8B is a top view of the embodiment shown in FIG. 8A.

FIGS. 8A, 8B and 8C disclose another embodiment of the invention 70 wherein this embodiment includes a base section 71 which is shaped as a bowl having a rounded top. Inside base section 71 are side walls 73 with a plurality of holes 72 for receiving LED lights. These side walls dip down to form a deep bowl shaped product. In addition, there is a reflective protrusion 74 shaped as a dome which is coupled to a bottom end 75. Reflective dome shaped protrusion has a series of holes 76 which allow LED lights to fit through. Thus, these LED lights can fit through both holes 72 in side walls 73, and holes 76 in dome 74. Reflective dome 74 also includes a pre-dome section 78 which provides a transition area between bottom section 75 and dome section 74.

FIG. 8B shows a top view of this same embodiment showing that holes 72 and holes 76 are spaced opposite each other so that they can be used to light the surrounding reflective surface of base section 71. Base section 71 is reflective and can be made from a mirror finish material. In one embodiment however, reflective dome 74 can be made from a mirror finish material while the remaining reflective material can be made from a different material. FIG. 8C also discloses a side cross sectional view of this embodiment which shows that base section 71 also contains an outer wall 79 forming an outer peripheral rim cover for any LED lights that are coupled in.

Figure 9A:
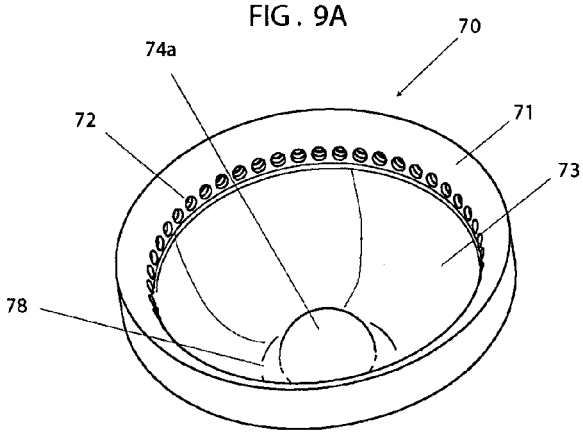
FIG. 9A is a perspective view of another embodiment of the invention.
Figure 9C:
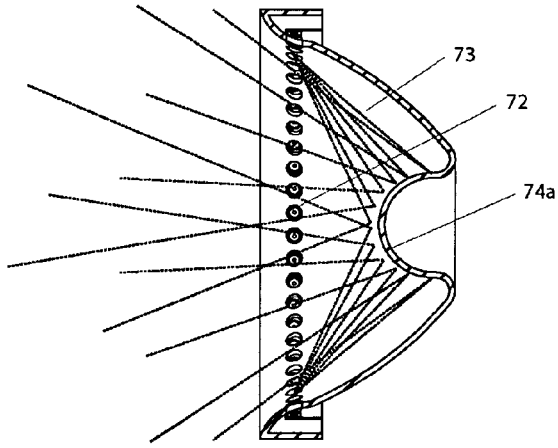
FIG. 9C is a side cross-sectional view of the embodiment shown in FIG. 9A taken through section A—A.
Figure 9B:
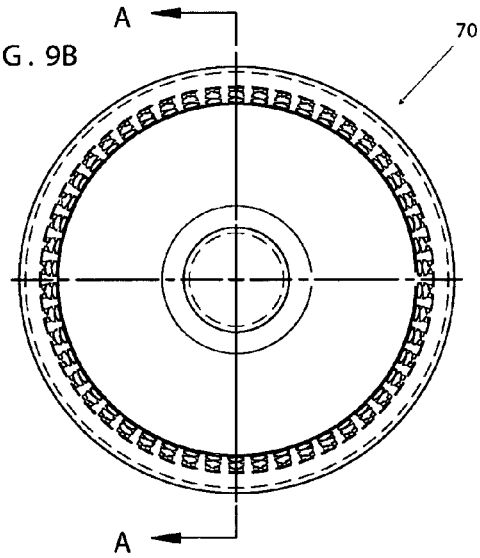
FIG. 9B is a top view of the view shown in FIG. 9A.

FIGS. 9A, 9B and 9C show a similar design as described above, however this design does not include holes 76 so that a new dome 74*a* is formed wherein this dome 74*a* is formed as an entirely reflective dome.

Figure 9D:
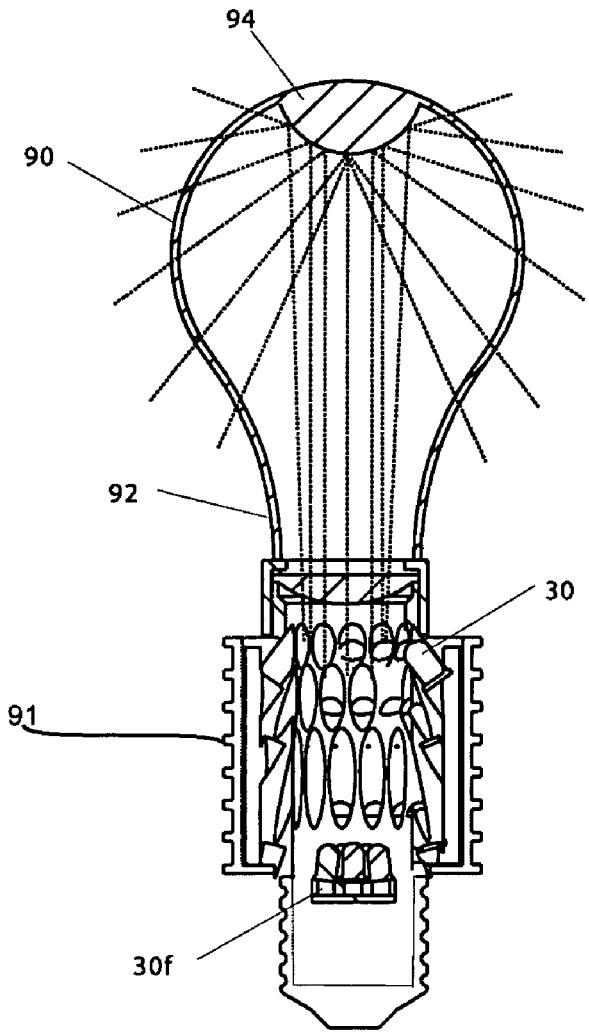
FIG. 9D is a side cross-sectional view of another emboidment of the invention.
Figure 9E:
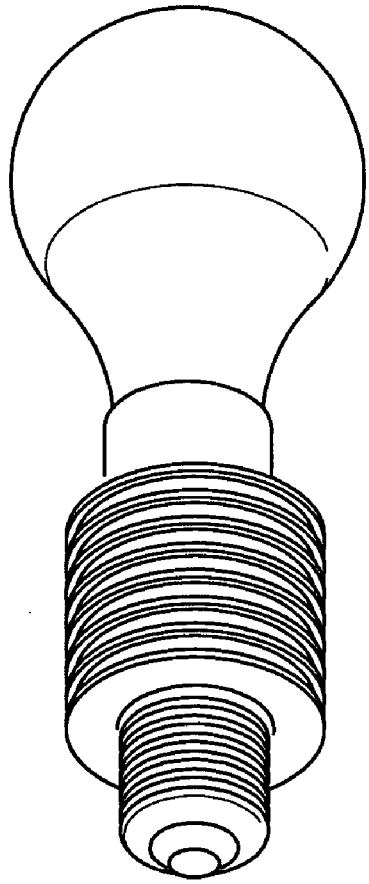
FIG. 9E is a perspective view of the device shown in FIG. 9D.

FIG. 9D shows a cross-sectional view of another embodiment of the device 90. In this view there is a base cap 91 which includes LED array 30*f* which sends light into a substantially translucent light housing 92 shaped substantially like a light bulb. This light housing has a reflective protrusion 94 which is shaped as a dome made from material having a reflective material finish which then reflects light out into a room to create the effect of a substantially uniform light source in all directions. In addition a prismatic film such as prismatic film 101 or 102 shown in FIG. 1B or 1C may be incorporated into housing 92 to increase the illuminating effect of LED lights 30. FIG. 9E shows a perspective view of this device as well.

Figure 10A:
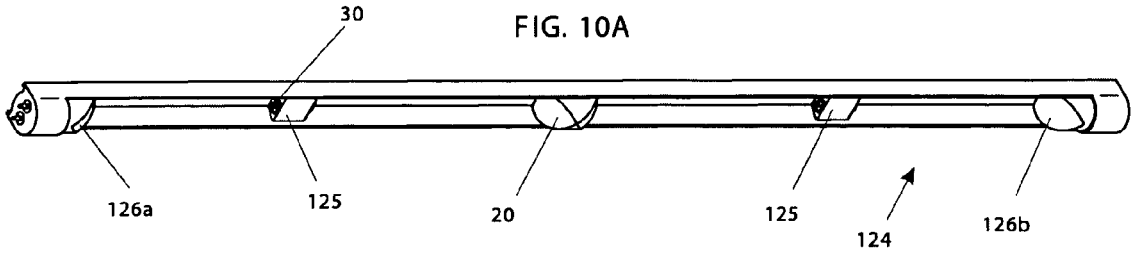
FIG. 10A is a perspective view of another embodiment of the device.
Figure 10B:
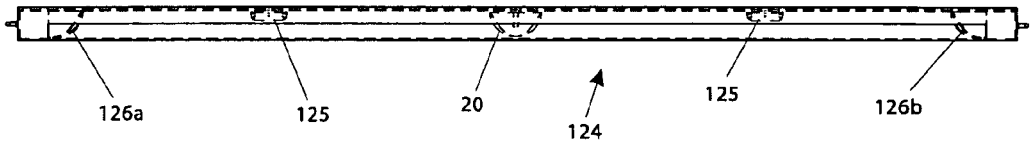
FIG. 10B is a side view of the device shown in FIG. 10A.

FIGS. 10A and 10B show another embodiment of the invention 124 which includes an additional intermediate LED station 125 which includes LED lights 30 coupled therein as well as a surrounding reflective housing. With this design, LED light points out in two directions from LED stations 125. In a first direction, light emanates from station 125 towards reflector 20. In the second direction, light emanates out from stations 125 and on to side reflectors 126*a* and 126*b* which are formed as slanted, rounded reflectors which reflect light down into a room.

Figure 11A:
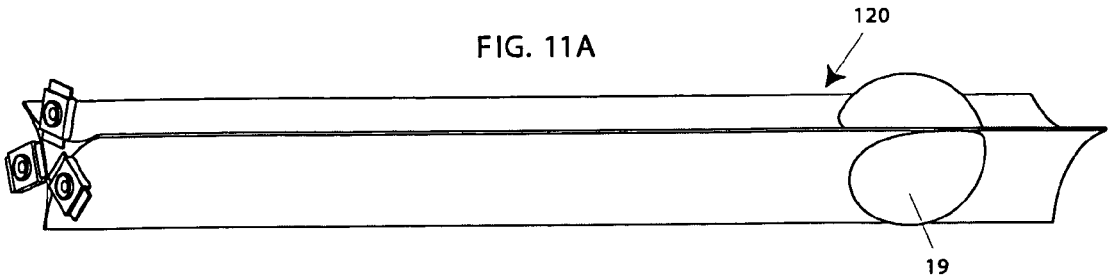
FIG. 11A is a perspective view of a new reflector.
Figure 11B:
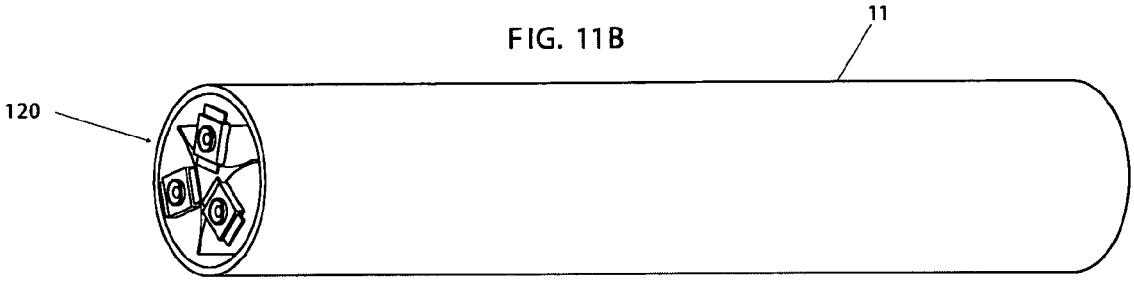
FIG. 11B is a perspective view of the reflector of FIG. 11A inserted into a tube.
Figure 11C:
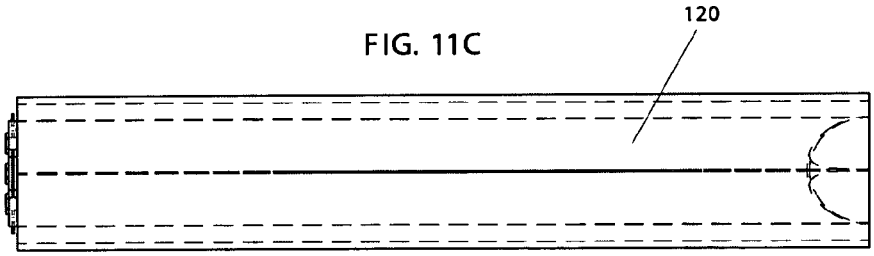
FIG. 11C is an end view of the device in FIG. 11B.
Figure 11D:
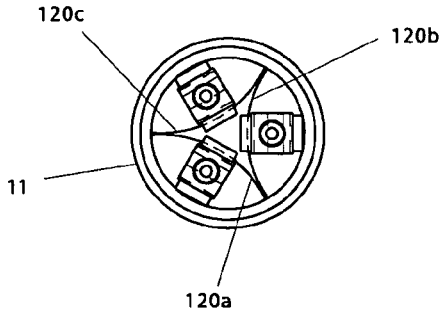
FIG. 11D is a side view of the device shown in FIG. 11C.

FIGS. 11A, 11B, 11C and 11D show another type of reflector 120 that can be inserted into tube 11. Reflector 120 can be formed as three concave reflectors 120*a*, 120*b*, and 120*c* that can have a mirror or substantially mirror type finish that allows light to be reflected out from tube 11. This reflector 120 is designed to intersect a spherical reflector 19 in a central region as shown in FIG. 11A with an opposite set of reflectors 120 intersecting spherical reflector 120 on an opposite side.

Figure 12A:
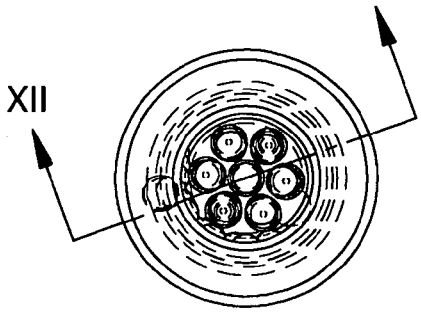
FIG. 12A is an end view of one of the endcaps.
Figure 12B:
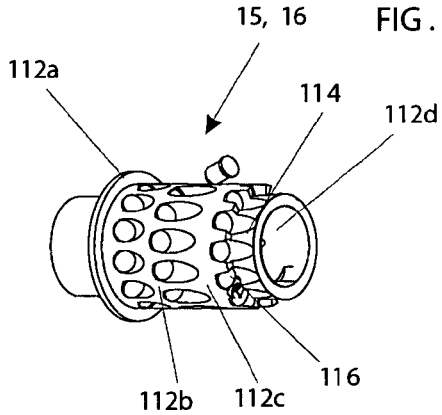
FIG. 12B is a perspective view of the endcaps shown in FIG. 12A.
Figure 12C:
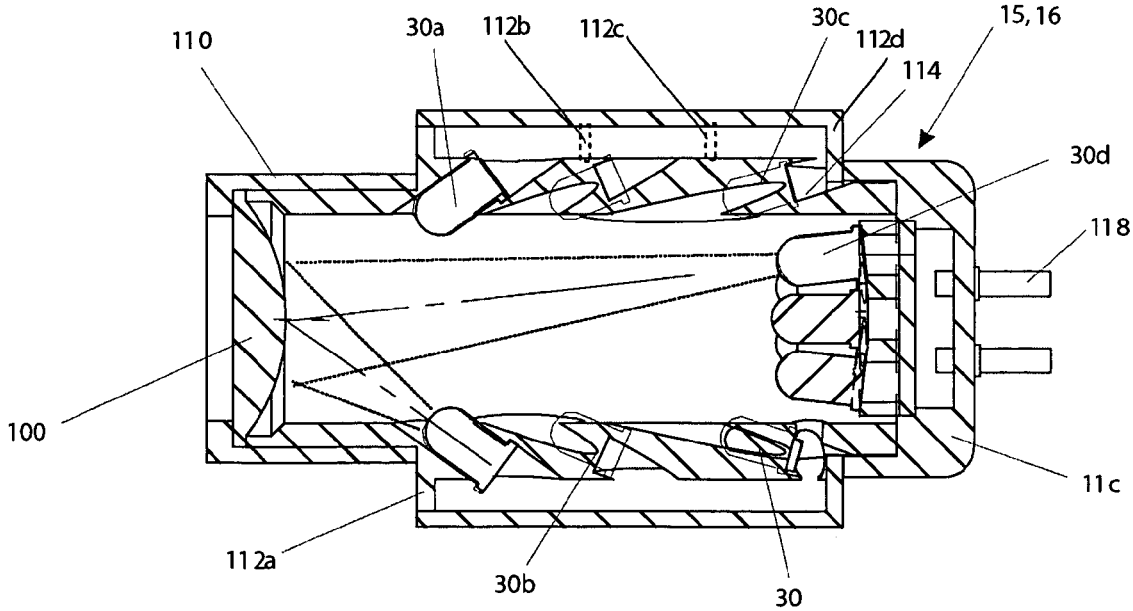
FIG. 12C is a cross-sectional view through line XII—XII of the endcaps shown in FIG. 12A.

FIGS. 12A, 12B and 12C disclose three different views of endcaps 15, and 16. FIG. 12A is an end view of endcaps 15 and 16, FIG. 12B is a perspective view, while FIG. 12C is a cross-sectional view through line XII—XII. These endcaps are formed as substantially cylindrical endcaps having a first cylindrical connecting section 110, a flange or heat sink 112*a* coupled to connecting section 110 and a back support section 114 coupled to flange 112*a*. Connecting section 110 is sized to fit into a tube or housing wherein connecting section 110 has a circular cross section. Flange or heat sink 112*a* extends radially out from connecting section 110 and is used to dissipate heat away from the LED lights coupled into back support section 114.

Back support section 114 has a plurality of holes 116 which are adapted to receive a plurality of LED lights 30 forming arrays 30*a*, 30*b*, 30*c*, and 30*f* which extend in and shine in at an angle. Disposed between these holes are additional optional flanges represented by dashed lines 112*b*, 112*c* and 112*d* wherein these flanges also act as heat sinks. In addition, connecting section 110 is also adapted to receive a lens 100 (See also FIG. 1A), wherein lens 100 focuses and allows light to extend out from endcaps 15 and 16. Extending out from back support section 114 is a back electrical connection 116 containing prongs 118 for connection to an electrical light socket such as a light socket for fluorescent bulbs.

Figure 12D:
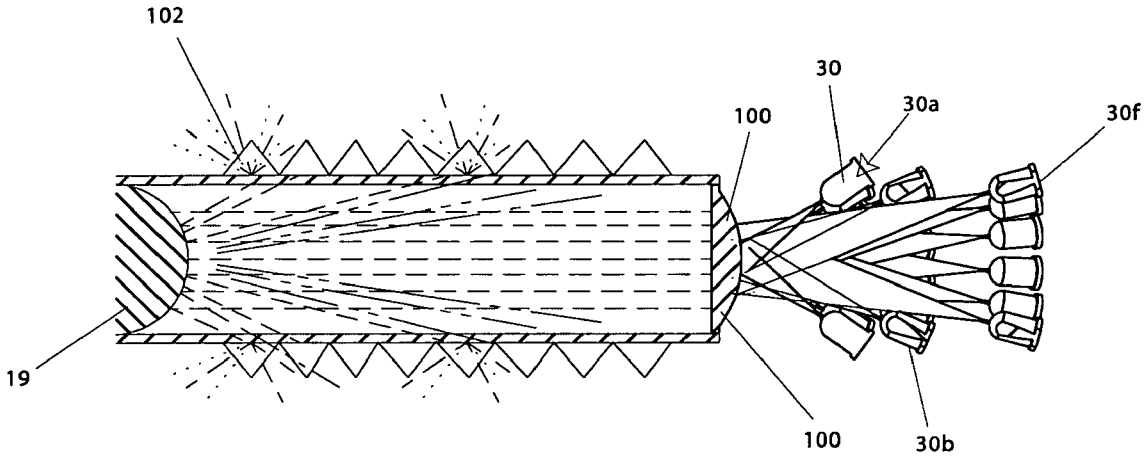
FIG. 12D is a cross sectoinal view of the device with the endcaps removed showing the collimating effect of the lens.

FIG. 12D shows a side cross-sectional view of the device wherein the light housing has been removed and this view reveals LED arrays 30*a*, 30*b*, and 30*f* all showing light being sent in from LED lights 30 into a central region of lens 100 wherein this light is then collimated and then sent as a steady stream to reflector 19.

Figure 13A:
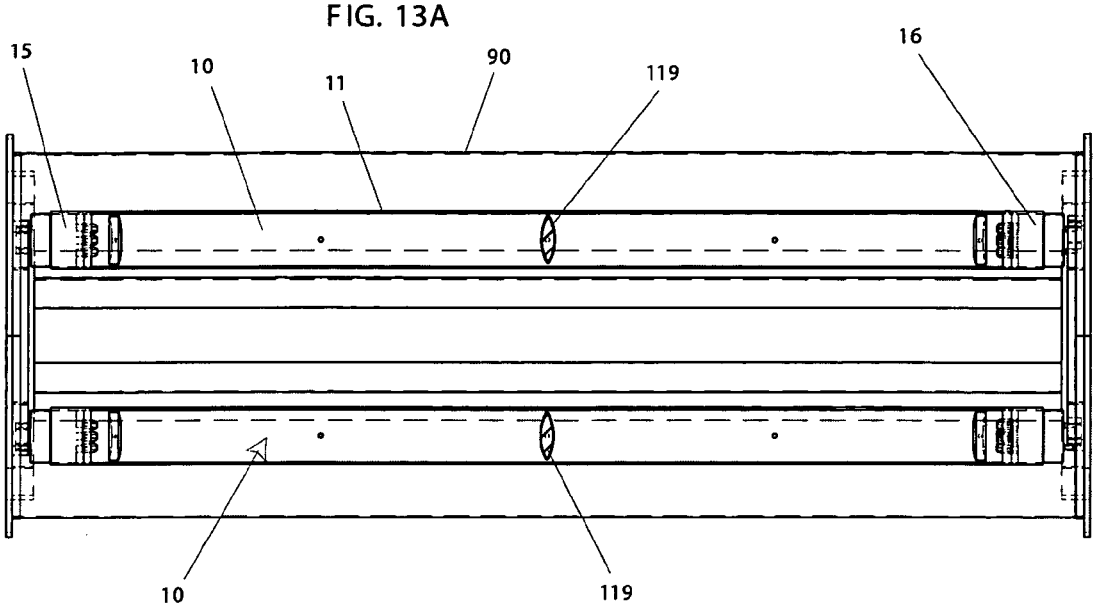
FIG. 13A is a top view of the device inserted into a lighting housing for mounting in a ceiling.

FIG. 13A shows a plan view of two of the devices 10 coupled into a lighting housing 90 which can be similar to a florescent lighting housing. In this view, device 10 has end caps 15, and 16 which are coupled into tube 11 and shine light on a substantially oval shaped reflector 119, which is disposed in a central section of tube 11.

Figure 13B:
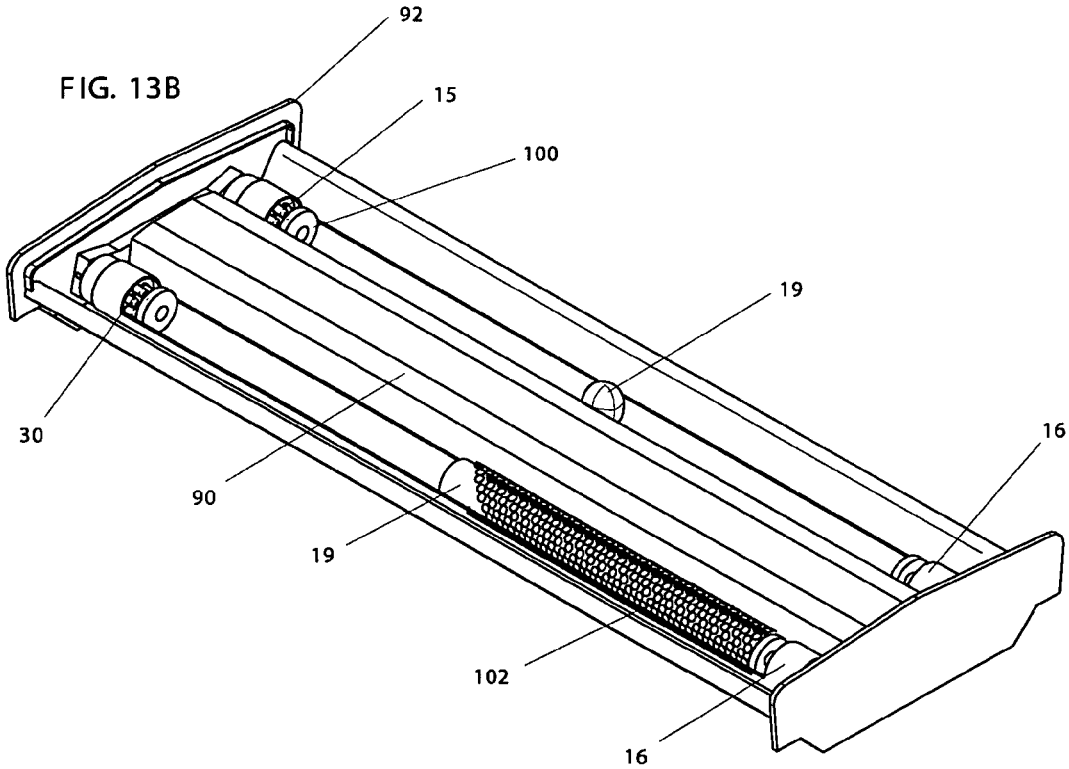
FIG. 13B is a perspective view of the device shown in FIG. 13A.

FIG. 13B shows a perspective view of a substantially similar design to that shown in FIG. 13A, however, this design includes spherical reflector 19 shown in FIG. 1A. In this design, lighting housing 90 includes end plates 92 as well. In one of these devices 10, there is no cover or tube 11 which has been removed to reveal spherical reflector 19. In the other device there is at least a partial view of a cover or tube 11*b*, which includes a prismatic covering 102 which is used to reflect, and refract light to amplify the appearance of light. In addition, in this view, lenses 100 are also shown disposed adjacent to LED lights 30.

Figure 14A:
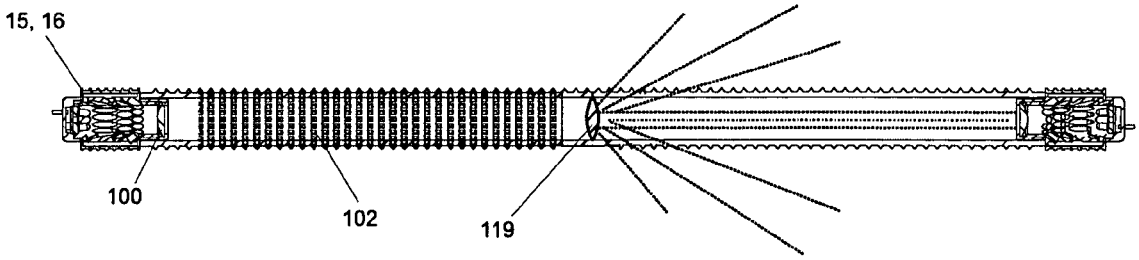
FIG. 14A is a side view of the device shown in 14A with a section of the cover removed.
Figure 14B:
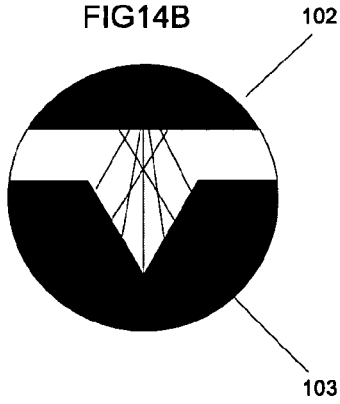
FIG. 14B is a close-up view of one of the prisms in a prism sheet.

FIG. 14A shows a closer view of this prismatic lens covering 102, which is used to deflect light. For example, FIG. 14B shows an even closer view of prismatic lens system 102 wherein this prismatic lens system includes a plurality of extensions 103 spikes, or pyramidal shaped tetrahedrons, which provide unique features in reflecting light.

Figure 15:
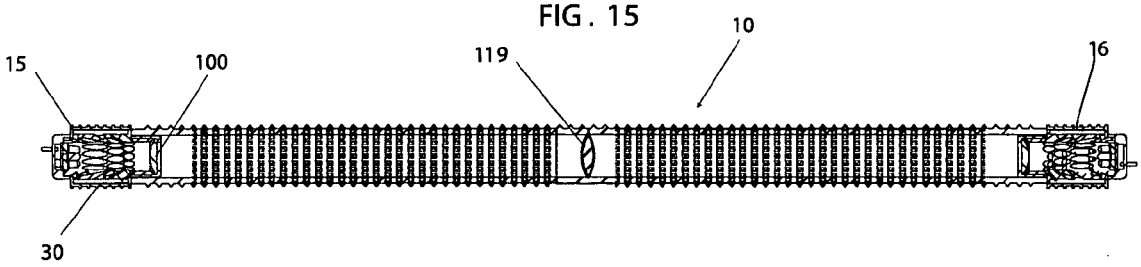
FIG. 15 is a side view with a center section of the tube removed for viewing a reflector.

FIG. 15 shows that prismatic lens system 102 extends substantially across tube 11 from endcap 15 to encap 16, over reflector 119 and adjacent to lens 100. The prismatic lens system 102 does not need to extend all the way to cover lens 100 because lens 100 acts as a collimator of light which focuses light emanating from LED lights 30 across tube 11 so that light extends through the tube to reflector 119.

Figure 16:
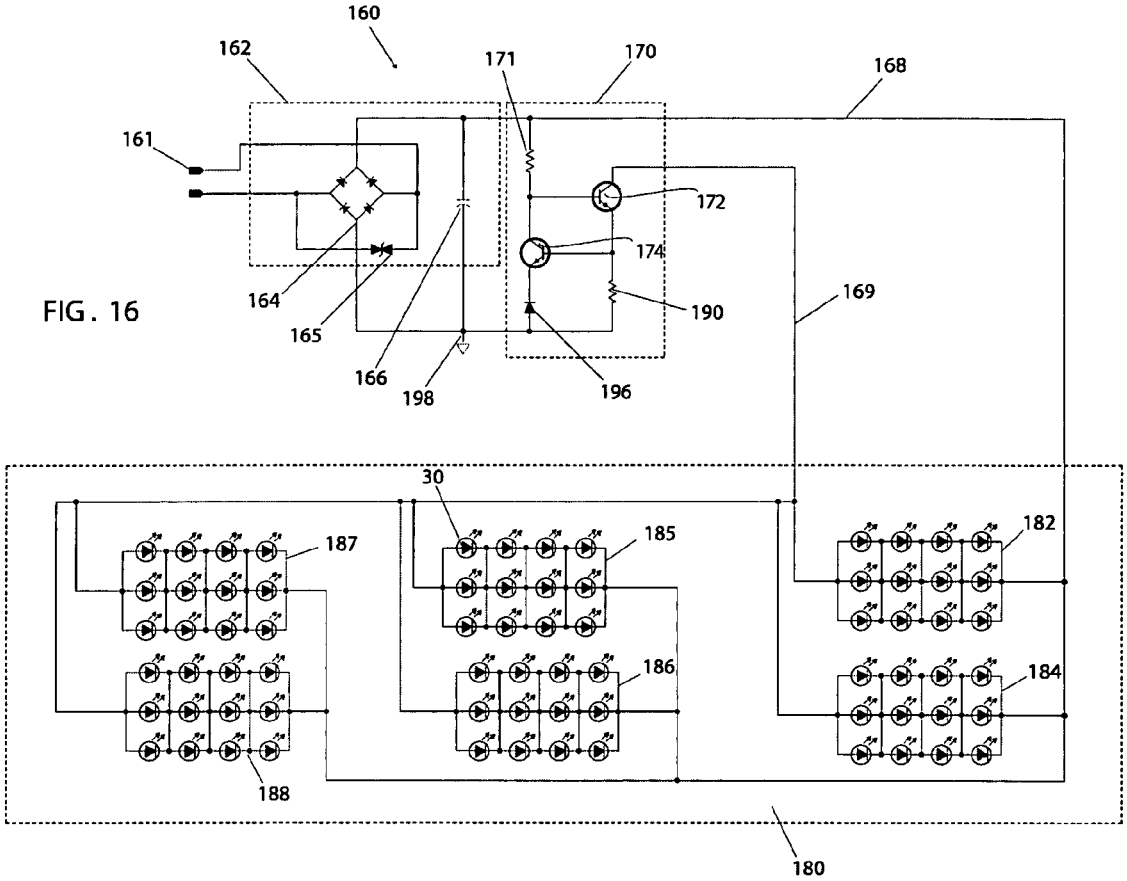
FIG. 16 is a schematic diagram of a circuit for use with the device.

FIG. 16 shows a schematic electronic circuit diagram for the electronic circuitry for controlling power which is used to light the LED lights. This circuit 160 can be disposed in end section 116 in either endcap 15 or endcap 16. Circuit 160 can include a power input connector 161 which can be in the form of prongs 118 extending out from back end section 116 (See FIG. 12C).

The circuit can also include an AC/DC converter 162, a current regulator 170 and an LED load section 180 including a plurality of LED arrays. The power, which in all likelihood is AC power, can then feed into AC/DC converter 162, which converts the AC current into DC current. In an alternative embodiment, this AC/DC converter can be in the form of a DC/DC converter as well. In either case, there is a bridge rectifier 164 to convert the current from AC to DC and at least one capacitor 166 to smooth out the waves to provide a reasonably steady current. To protect bridge rectifier 164 there is a surge protector 165 coupled in parallel with bridge rectifier 164 to provide protection against sudden surges in power. This power flows down a circuit line 168 and feeds into current regulator 170. Current regulator 170 is designed to regulate the current flowing through the circuit so that LED lights 30 are not blown. In a preferred embodiment the current is regulated to be approximately 20 ma.

Current regulator 170 can be used to regulate the current so that there is always a consistent amount of current flowing through the circuit. This current regulator cannot provide an absolutely consistent current but rather provides a relatively narrow current range for current flowing through the circuit. This current regulator receives current flowing through circuit 160 and includes two transistors. The bridge rectifier 164 provides a DC input. Capacitor 166 provides smoothing of the DC input. Zener diode or surge protector 165 provides input surge protection for the electronics. The proper operating voltage range is established through voltage dropping resistor 171 (R1) and transistor 172 (Q1). Transistor 174 (Q2) regulates the current through resistor 190 (R2) and provides the required current to operate an LED array with the specific selected LED's operating current requirements. This regulated current then flows down line 168 into LED arrays 182, 184, 185, 186, 187 and 188 for powering LED lights 30.

LED load section 180, which includes LED arrays 182, 184, 185, 186, 187, 188. Each of the LED arrays are coupled both in series and in parallel so that if one LED array is blown or destroyed the remaining LED arrays can receive power. In addition, each of the LED lights in each LED array is coupled in both series and parallel so that if one individual LED light is blown the remaining LED lights in each individual array can still shine.

With this design, the device can be coupled to a plurality of different power units, which can each have different voltage inputs. For example, power units having voltages in the order of 12V, 24V, 37V, 48V, 76V, 95V or 120V can be used to power this device because the current is always regulated by current regulator 170.

Figure 17A:
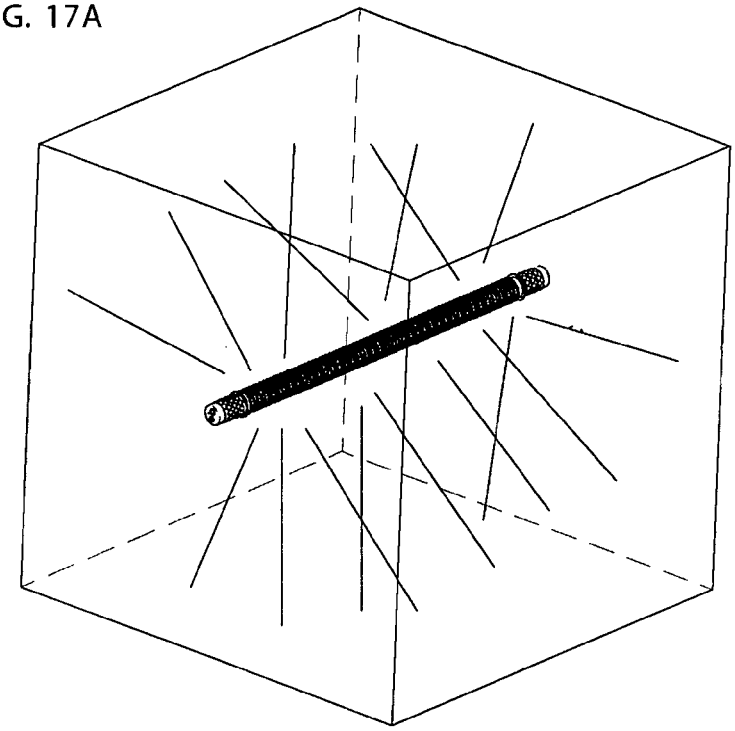
FIG. 17A is a perspective view of the device showing a uniform light distribution pattern.
Figure 17B:
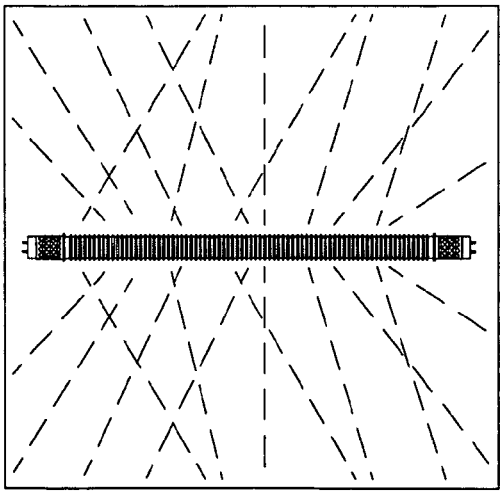
FIG. 17B is a side view of the device showing a uniform light distribution pattern.
Figure 17C:
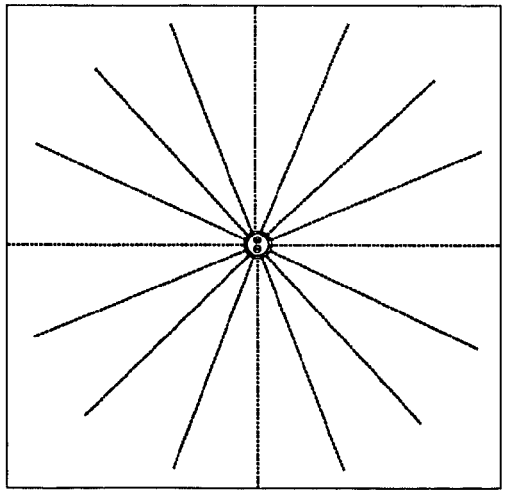
FIG. 17C is a side view of the device rotated 90° showing a uniform light distribution pattern.

With this design, device 10 having a reflector 19 or 20 and a set of LED arrays coupled into endcaps 15 or 16 can be used to create an omnidirectional light which creates a uniform light distribution pattern flowing from LED lights as shown in FIGS. 17A, 17B and 17C. This design with the circuit above is then adaptable to different power inputs such as those on cars trains or in houses to provide a lighting design that is inexpensive to operate.

Accordingly, while at least one embodiment of the present invention have been shown and described, it is to be understood that many changes and modifications may be made thereunto without departing from the spirit and scope of the invention as defined in the appended claims.

What is claimed is:

1. A light comprising:

a) a housing;

b) a plurality of LED lights coupled in an array inside said housing;

c) a heat sink disposed in said housing, wherein said plurality of LED lights are disposed in said heat sink;

d) a reflector which is dome shaped, coupled to said housing wherein said reflector is for reflecting light from said plurality of LED lights out of said housing.

2. The device as in claim 1, wherein said housing is substantially tubular and includes at least one translucent section which allows light to flow therefrom.

3. The device as in claim 2, wherein said reflector has a surface that is substantially light reflecting and wherein light from said LED array is reflected off of said surface.

4. The device as in claim 3, wherein said LED array is coupled to a first end of said housing and a second LED array is coupled to a second end of said housing.

5. The device as in claim 2, wherein said housing has a first section that is substantially reflecting and a second section that is substantially translucent.

6. The device as in claim 2, further comprising a film made from prismatic lenses for reflecting and amplifying light emitted from said LED lights.

7. The device as in claim 1, wherein said housing is substantially bowl shaped.

8. The device as in claim 1, wherein said heat sink is in the form of a flange extending radially out from said light housing.

9. The device as in claim 8, wherein said light housing is adapted to receive a plurality of LED arrays each coupled into said housing with each of said LED arrays being set so that said LED lights shine at different angles.

10. The device as in claim 1, wherein said reflector is shaped as an elongated rounded element.

11. The device as in claim 2, wherein said LED lights in said LED array are aligned to direct light along a longitudinal axis of said housing.

12. The device as in claim 2, wherein at least one of said LED lights in said LED array are formed at an angle in relation to a longitudinal axis of said housing.

13. A light comprising:

a) a housing;

b) a plurality of LED lights; and c) at least one collimating lens for collimating light sent from said LED light array;

d) at least one endcap housing coupled to said housing, said endcap housing in the form of a heatsink wherein said plurality of LED lights and said at least one collimating lens are coupled into said endcap housing;

e) at least one spherical reflector disposed in said housing for reflecting light sent from said at least one collimating lens out of said housing to create a uniform light distribution pattern.

14. The device as in claim 13, wherein said at least one heatsink is in the form of a flange extending radially out from said at least one endcap housing.

15. The device as in claim 13, wherein said endcap housing is adapted to receive a plurality of LED arrays with LED lights from at least a first set of LED arrays being set at an angle that is different than an angle of a set of lights in a second LED array.

16. A light comprising:

a) a housing, wherein said housing is substantially tubular and includes at least one translucent section which allows light to flow therefrom;

b) a plurality of LED lights coupled in an array inside said housing;

c) a heat sink disposed in said housing, wherein said plurality of LED lights are disposed in said heat sink d) a reflector, coupled to said housing wherein said reflector is for reflecting light from said plurality of LED lights out of said housing.

17. The light as in claim 16, wherein a light distributing film disposed on an exterior surface of the housing and is formed from a plurality of prismatic lenses.

18. A light comprising:

a) an elongated housing;

b) a plurality of LED lights disposed in said housing;

c) a reflector disposed in said housing;

d) a light distributing film in the form of a plurality of prismatic lenses disposed on an exterior surface of said housing, said light distributing film for creating a substantially uniform distribution of light outside of said housing.

* * * * *